US007569990B2

(12) United States Patent
Kim et al.

(10) Patent No.: US 7,569,990 B2
(45) Date of Patent: Aug. 4, 2009

(54) PLASMA DISPLAY PANEL HAVING MAIN AND QUXILIARY BARRIER RIBS

(75) Inventors: Hongyeol Kim, Gumi-si (KR); Yungi Kim, Busan (KR)

(73) Assignee: LG Electronics Inc., Seoul (KR)

( * ) Notice: Subject to any disclaimer, the term of this patent is extended or adjusted under 35 U.S.C. 154(b) by 56 days.

(21) Appl. No.: 11/283,764

(22) Filed: Nov. 22, 2005

(65) Prior Publication Data

US 2006/0125367 A1 Jun. 15, 2006

(30) Foreign Application Priority Data

Nov. 23, 2004 (KR) ..... 10-2004-0096621

(51) Int. Cl.
*H01J 17/49* (2006.01)

(52) U.S. Cl. ..... 313/582; 313/587

(58) Field of Classification Search ..... 313/582–587
See application file for complete search history.

(56) References Cited

U.S. PATENT DOCUMENTS 6,048,243 A * 4/2000 Kosaka et al. ..... 445/24
7,285,914 B2 * 10/2007 Jeon ..... 313/587
2002/0003405 A1 1/2002 Kang
2004/0046505 A1 * 3/2004 Kawanishi ..... 313/586
2004/0201351 A1 10/2004 Woo et al.

FOREIGN PATENT DOCUMENTS

EP 1 388 876 A1 2/2004
JP 2004-319486 A 11/2004
KR 10-0238361 10/1999

* cited by examiner

*Primary Examiner*—Joseph L Williams
*Assistant Examiner*—Bumsuk Won
(74) *Attorney, Agent, or Firm*—Birch, Stewart, Kolasch & Birch, LLP

(57) ABSTRACT

There is provided a plasma display panel, and more particularly, to a barrier rib structure of a plasma display panel. The plasma display panel comprises a main barrier rib formed on an effective surface of a panel to form a discharge cell; and an auxiliary barrier rib which protrudes in at least one of a horizontal direction or a vertical direction from the effective surface of the panel.

22 Claims, 7 Drawing Sheets

PLASMA DISPLAY PANEL HAVING MAIN AND QUXILIARY BARRIER RIBS

This Nonprovisional application claims priority under 35 U.S.C. § 119(a) on Patent Application No. 10-2004-0096621 filed in Republic of Korea on Nov. 23, 2004, the entire contents of which are hereby incorporated by reference.

BACKGROUND OF THE INVENTION

1. Field of the Invention

The present invention relates to a plasma display panel, and more particularly, to a barrier rib structure of a plasma display panel.

2. Description of the Background Art

In general, in a plasma display panel, barrier ribs formed between a front panel and a rear panel constitute a unit cell and main discharge gas such as Neon (Ne), Helium (He), or mixed gas (Ne+He) of Neon and Helium and inert gas containing a small amount of Xenon fill each cell. When discharge is performed by a high frequency voltage, the inert gas generates vacuum ultraviolet rays and allows a phosphor formed between the barrier ribs to emit light, and thus an image is embodied. Such a plasma display panel is made to be thin and light, so that it is in the spotlight as a next generation display device.

FIG. 1 is a view illustrating a structure of a general plasma display panel.

As shown in FIG. 1, in the plasma display panel, a front panel 100 in which a plurality of sustain electrode pairs formed in a pair of a scan electrode 102 and a sustain electrode 103 are arranged in a front glass 101, that is, a display surface in which an image is displayed and a rear panel 100 in which a plurality of address electrodes 113 is arranged to intersect the plurality of sustain electrode pairs on a rear glass 111 forming a rear surface are coupled to be disposed apart a predetermined distance from and to be parallel to each other.

The front panel 100 performs reciprocal discharge in one discharge cell and comprises pairs of the scan electrode 102 and the sustain electrode 103 for sustaining light emitting of a cell, i.e., the scan electrode 102 and the sustain electrode 103 provided with a transparent electrode (a) made of a transparent ITO material and a bus electrode (b) made of a metal material. The scan electrode 102 and the sustain electrode 103 prevent a discharge current from flowing and are covered with a dielectric layer 104 for isolating the electrode pair, and a protective layer 105 evaporated with a magnesium oxide (MgO) is formed on an upper surface of the upper dielectric layer 104 to facilitate a discharge condition.

In the rear panel 110, stripe type barrier ribs 112 for forming a plurality of discharge spaces, i.e., discharge cells are disposed in parallel. Further, many address electrodes 113 for generating vacuum ultraviolet rays by performing address discharge are disposed in parallel to the barrier rib 112. A RGB phosphors 114 emitting visible rays for displaying an image upon address discharge are coated in the upper surface of the rear panel 110. A lower dielectric layer 115 for protecting the address electrode 113 is formed between the address electrode 113 and the phosphor 114.

Hereinafter, a barrier rib structure of a plasma display panel having such a structure will be described.

A conventional plasma display panel has several barrier rib structures. A stripe type barrier rib structure and a well type barrier rib structure as representative barrier rib structures among them will be described as follows.

FIGS. 2A and 2B are diagrams illustrating a barrier rib structure of a conventional plasma display panel.

In FIG. 2A, a stripe type barrier rib structure of the plasma display panel is shown. Referring to FIG. 2A, the stripe type barrier rib structure has a structure in which a barrier rib 210 is vertical to a sustain electrode consisting of a bus electrode 220 and a transparent electrode 230 and disposed in a stripe shape.

In FIG. 2B, a well type barrier rib structure of the plasma display panel is shown. Referring to FIG. 2B, the well type barrier rib structure has a structure in which a barrier rib 310 is horizontal or vertical to a sustain electrode consisting of a bus electrode 320 and a transparent electrode 330 and disposed in a well shape.

In addition to the above structures, there are a triangle type barrier rib structure, a delta type barrier rib structure, and a waffle type barrier rib structure.

As an example, the waffle type barrier rib structure will be described.

FIG. 3 is a diagram illustrating deformation of a barrier rib upon firing of a barrier rib of the plasma display panel.

Referring to FIG. 3, it can be seen that the edge of the barrier rib is contracted (A') due to firing of the barrier rib of the plasma display panel. At this time, a discharge cell (A) positioned at the edge of the barrier rib is deformed due to contraction (A') of the barrier rib. For example, the edge of the barrier rib is contracted (A') and thus the discharge cell (A) is also contracted (a') and deformed. Here, filing means an operation of making a hardening material by heating the mixed materials.

Contraction (a') of the discharge cell (A) due to contraction (A') of the barrier rib of the plasma display panel has a bad influence on reliability of the plasma display panel. That is, a defective pixel is generated on an effective surface in which an image of the plasma display panel is displayed and thus erroneous discharge occurs upon driving, so that reliability is deteriorated. An effective surface is an area expressing an image and comprises a dummy cell region as well as a discharge cell region for directly expressing an image.

FIG. 4 is a diagram illustrating an influence in which deformation of a barrier rib of the plasma display panel has on an effective surface of the panel.

Referring to FIG. 4, a black spot (A) is generated in the edge of an effective surface 400 of the plasma display panel adjacent to an ineffective surface 410 thereof. The spot is generated as the discharge cell (A) becomes a defective pixel in which discharge is not generated due to deformation of a discharge cell (A) caused by contraction (a') of a barrier rib upon firing of the barrier rib of a discharge cell (A) shown in FIG. 3.

Therefore, a discharge cell is deformed due to contraction of a barrier rib upon firing of the barrier rib and a defective pixel is generated due to deformation of the discharge cell, so that reliability of the plasma display panel is deteriorated.

SUMMARY OF THE INVENTION

Accordingly, an object of the present invention is to solve at least the problems and disadvantages of the background art.

An object of the present invention is to provide a barrier rib structure of a plasma display panel which can prevent deformation of a discharge cell for expressing an image.

According to an aspect of the present invention, there is provided a plasma display panel comprising a main barrier rib formed on an effective surface of a panel to partition a discharge cell; and an auxiliary barrier rib which protrudes in at least one of a horizontal direction or a vertical direction from the effective surface of the panel and whose the tips are not connected to each other.

According to the present invention, deformation of a discharge cell is prevented by manufacturing a barrier rib in a different method upon manufacturing of a plasma display panel, so that it is possible to improve reliability of a plasma display panel.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

Hereinafter, exemplary embodiments of the present invention will be described in detail with reference to the accompanying drawings.

Figure 1:
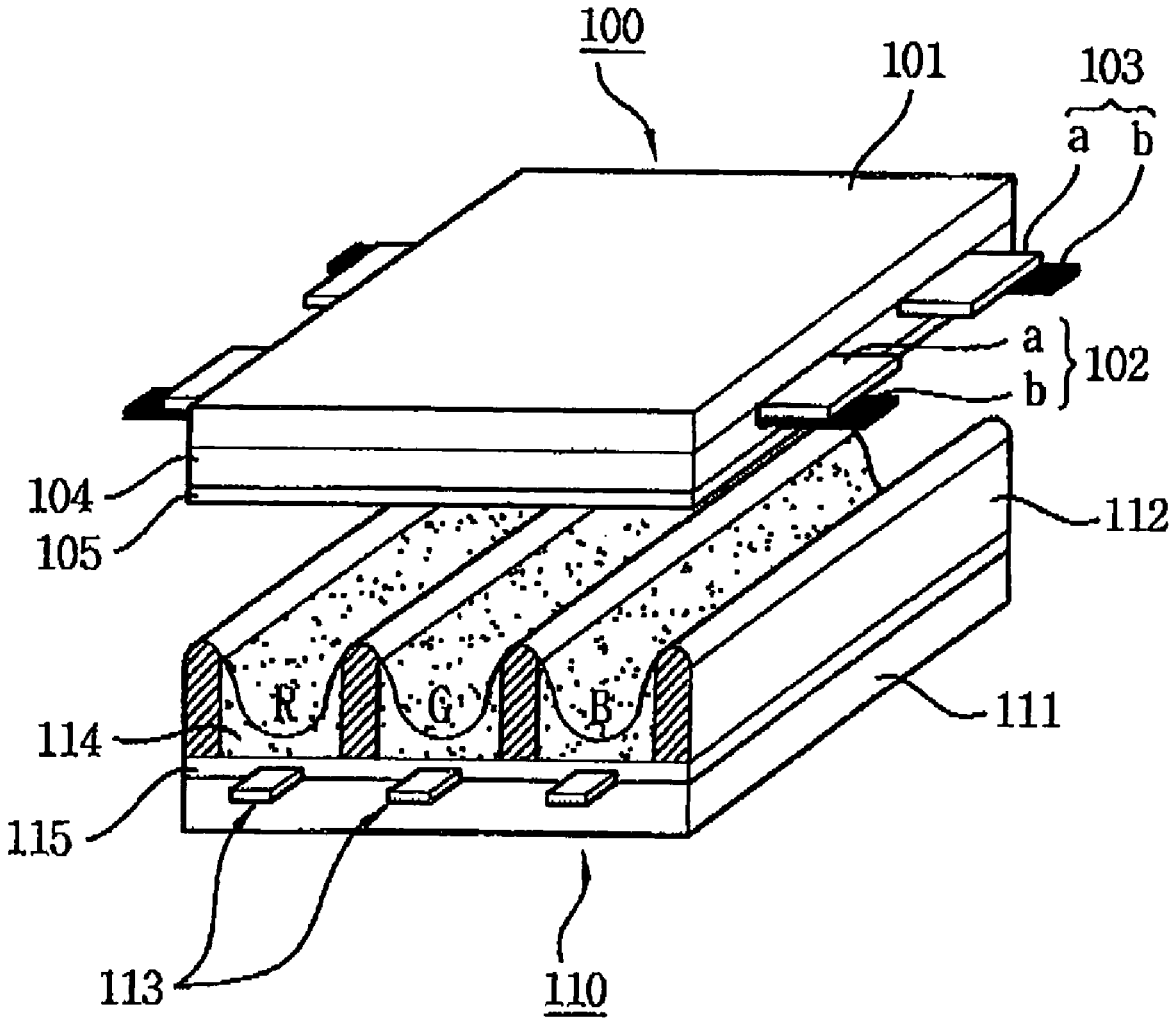
FIG. 1 is a view illustrating a structure of a general plasma display panel.
Figure 2A:
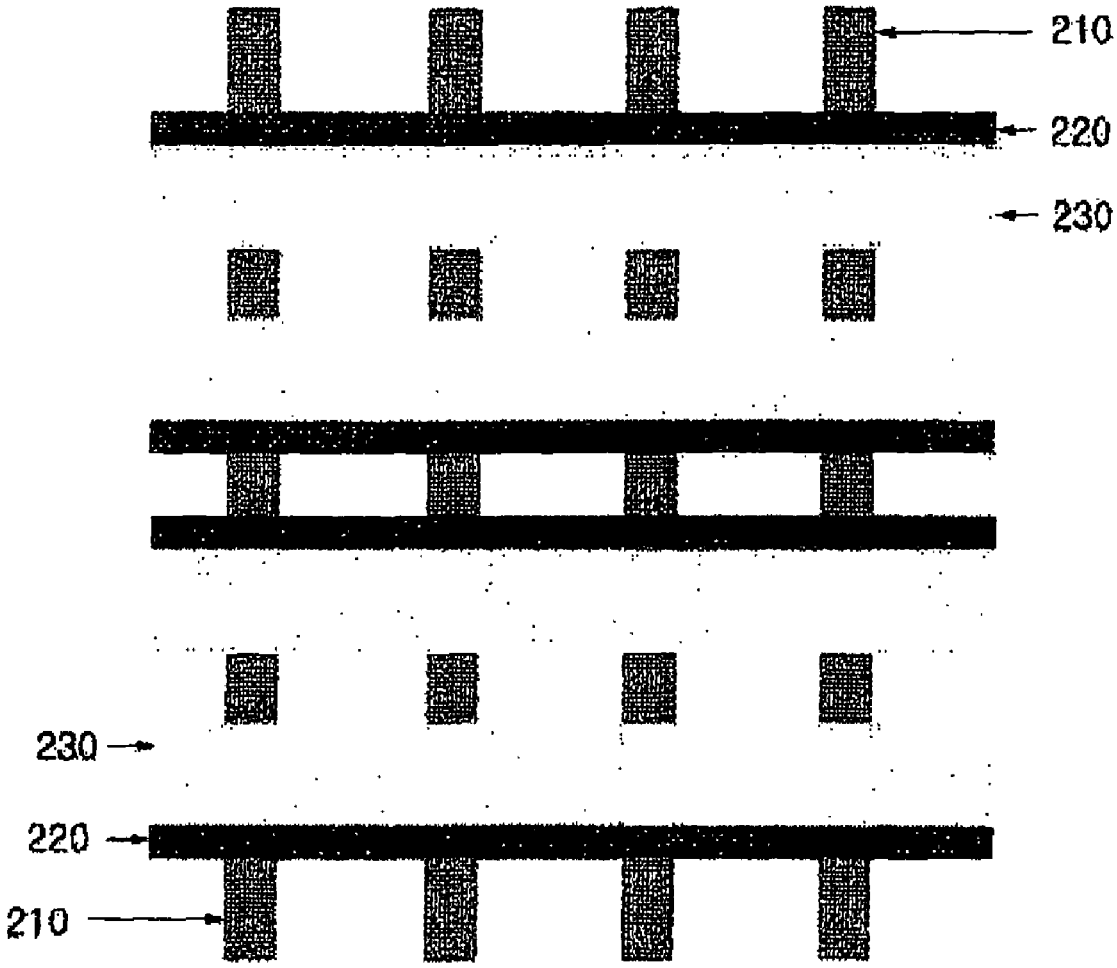
FIGS. 2A and 2B are diagrams illustrating a barrier rib structure of a conventional plasma display panel.
Figure 2B:
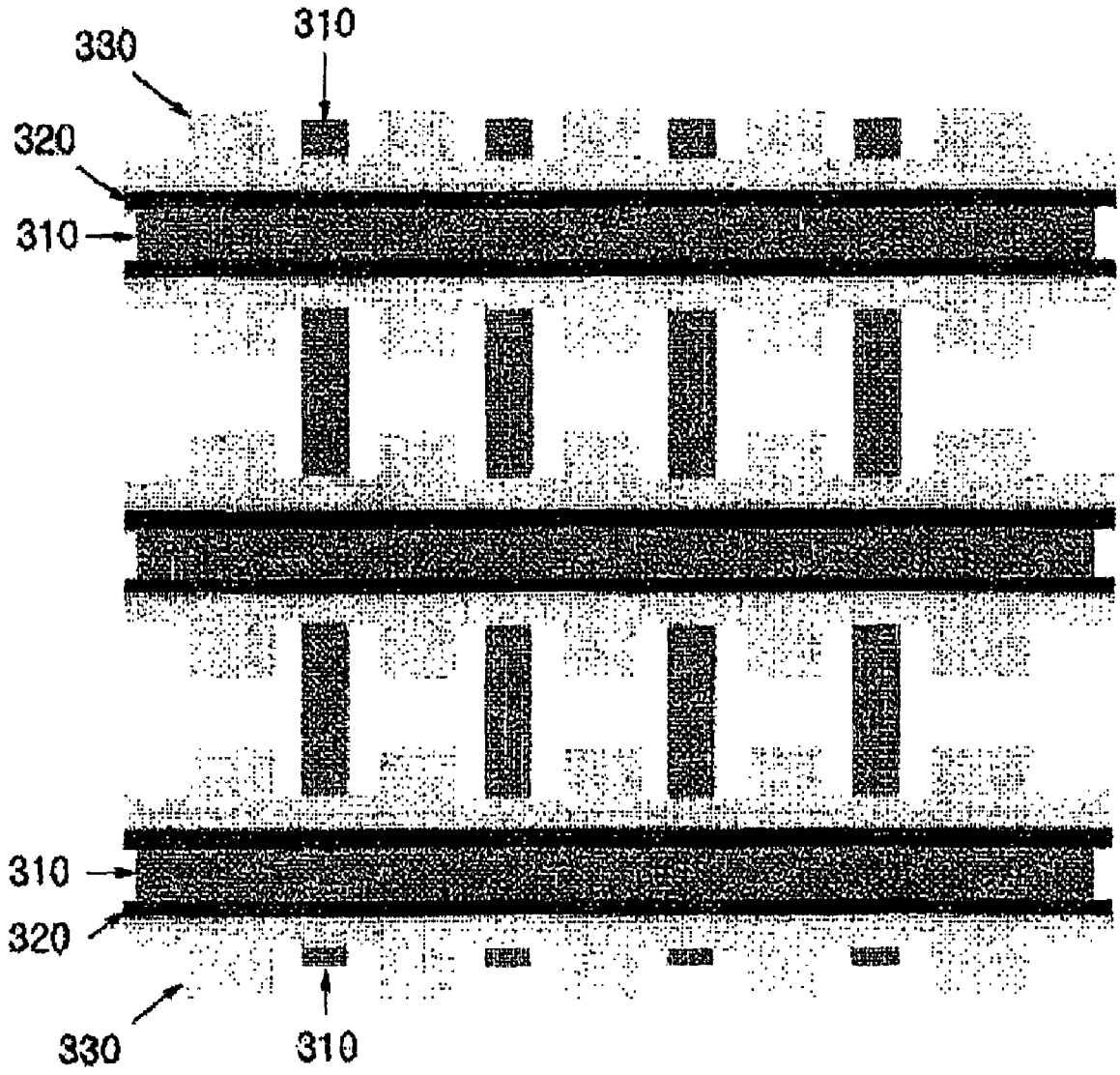
Figure 3:
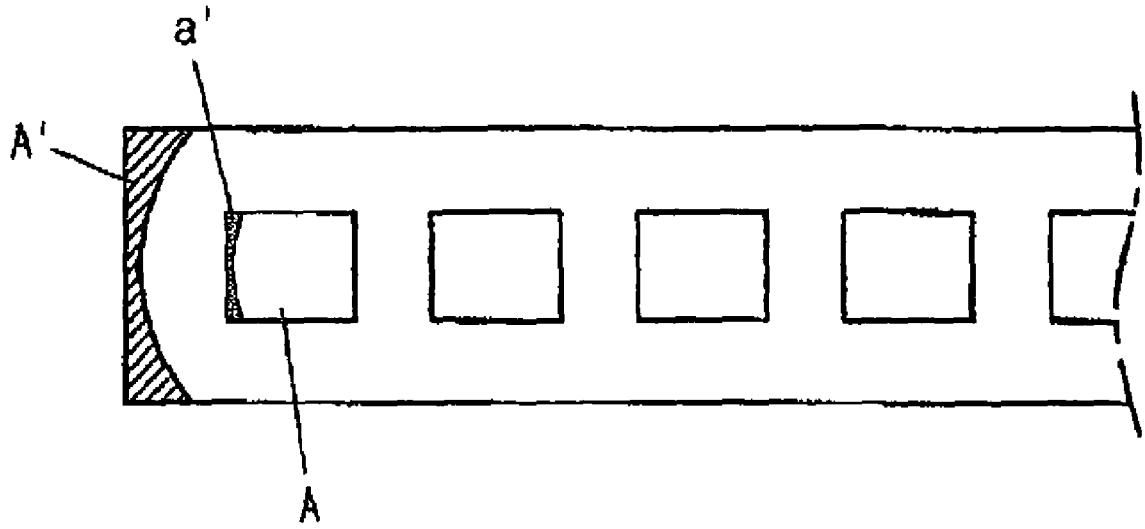
FIG. 3 is a diagram illustrating deformation of a barrier rib upon firing of the barrier rib of the plasma display panel.
Figure 4:
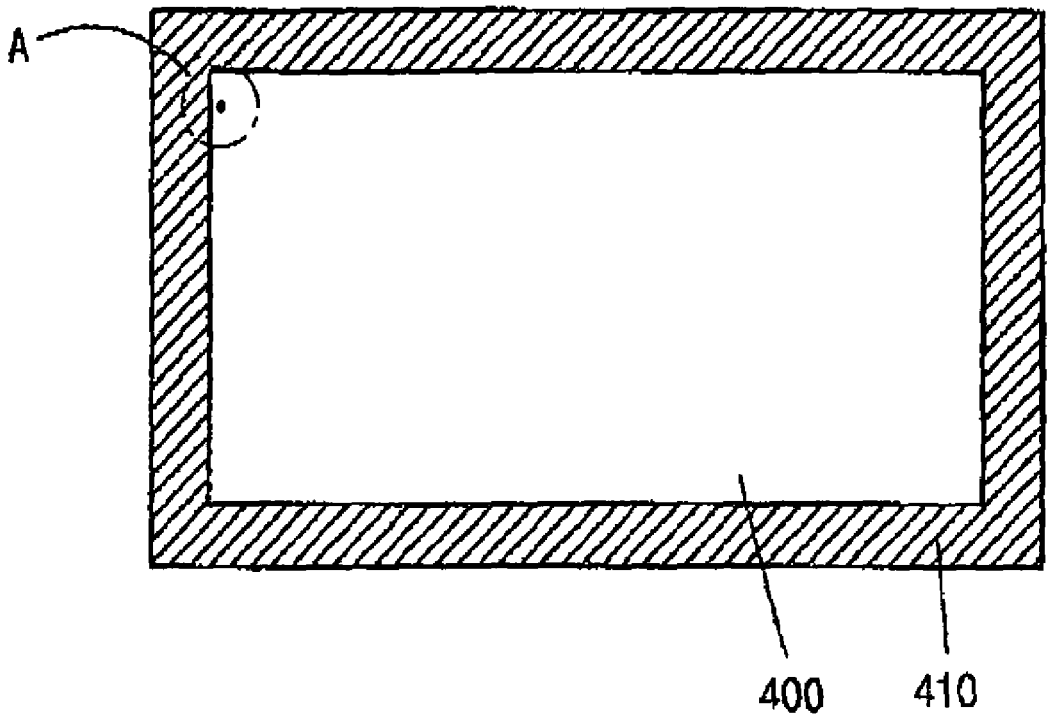
FIG. 4 is a diagram illustrating an influence in which deformation of the barrier rib of the plasma display panel has on an effective surface of the panel.
Figure 5:
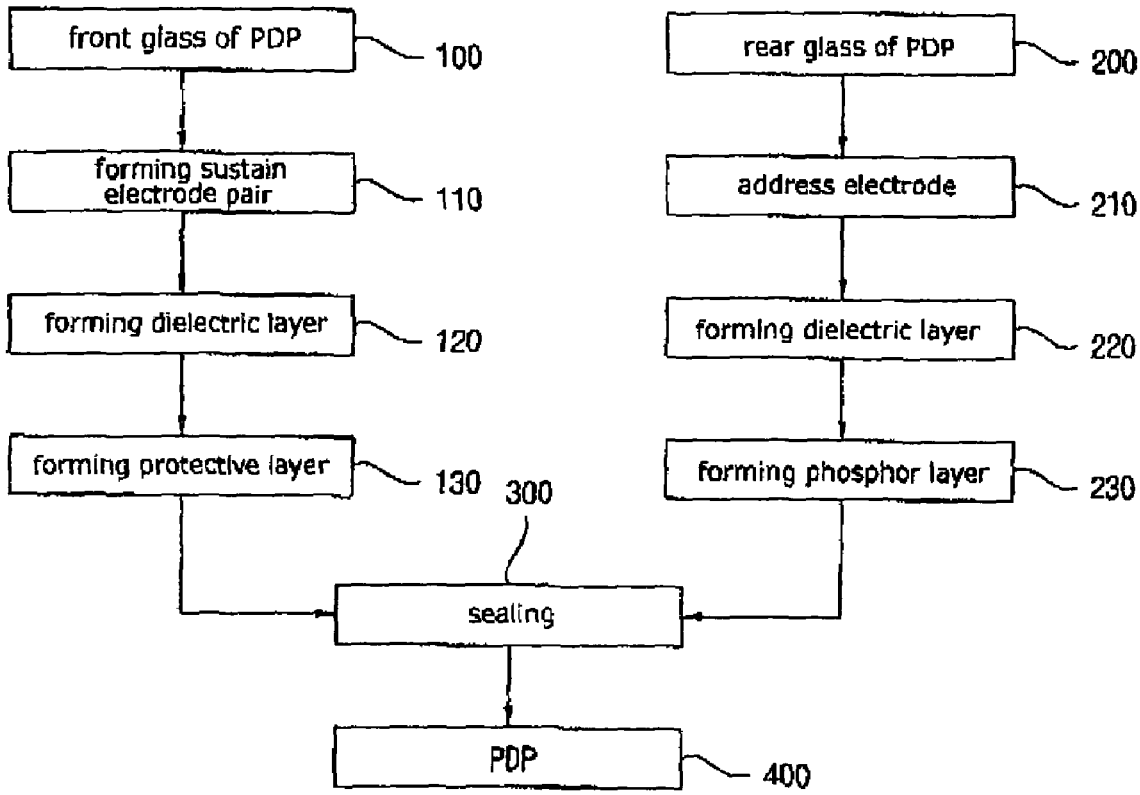
FIG. 5 is a block diagram sequentially illustrating a manufacturing method of the plasma display panel according to the present invention.

FIG. 5 is a block diagram sequentially illustrating a manufacturing method of the plasma display panel according to the present invention. As shown in FIG. 5, a manufacturing method of the plasma display panel according to the present invention comprises a front panel manufacturing process arranged in a left side of FIG. 5, a rear panel manufacturing process arranged in a right side of FIG. 5, and a sealing process arranged in a low side thereof.

First, the front panel manufacturing process arranged in a left side of FIG. 5 will be described as follows. In the front panel, a front glass to be a base member is first prepared (100) and then a plurality of sustain electrode pairs is formed on the front glass (110). Thereafter, an upper dielectric layer is formed on the sustain electrode pairs (120) and a protective layer made of a magnesium oxide (MgO) for protecting the sustain electrode pairs is formed on the upper dielectric layer (130).

Next, a rear panel manufacturing process arranged in a right side of FIG. 5 will be described as follows. In the rear panel, as in the front panel, a rear glass to be a base member is first prepared (200) and then a plurality of address electrodes opposing and intersecting the sustain electrode pairs formed on the front panel is formed on the rear glass (210). Thereafter, a low dielectric layer is formed on the address electrode (220) and a phosphor layer is formed on the lower dielectric layer (230).

The front panel and the rear panel thus manufactured are sealed to each other (300), thereby forming the plasma display panel (400).

In the manufacturing method of the plasma display panel according to the present invention, a manufacturing process of the rear panel will be described in detail with reference to FIG. 6.

Figure 6:
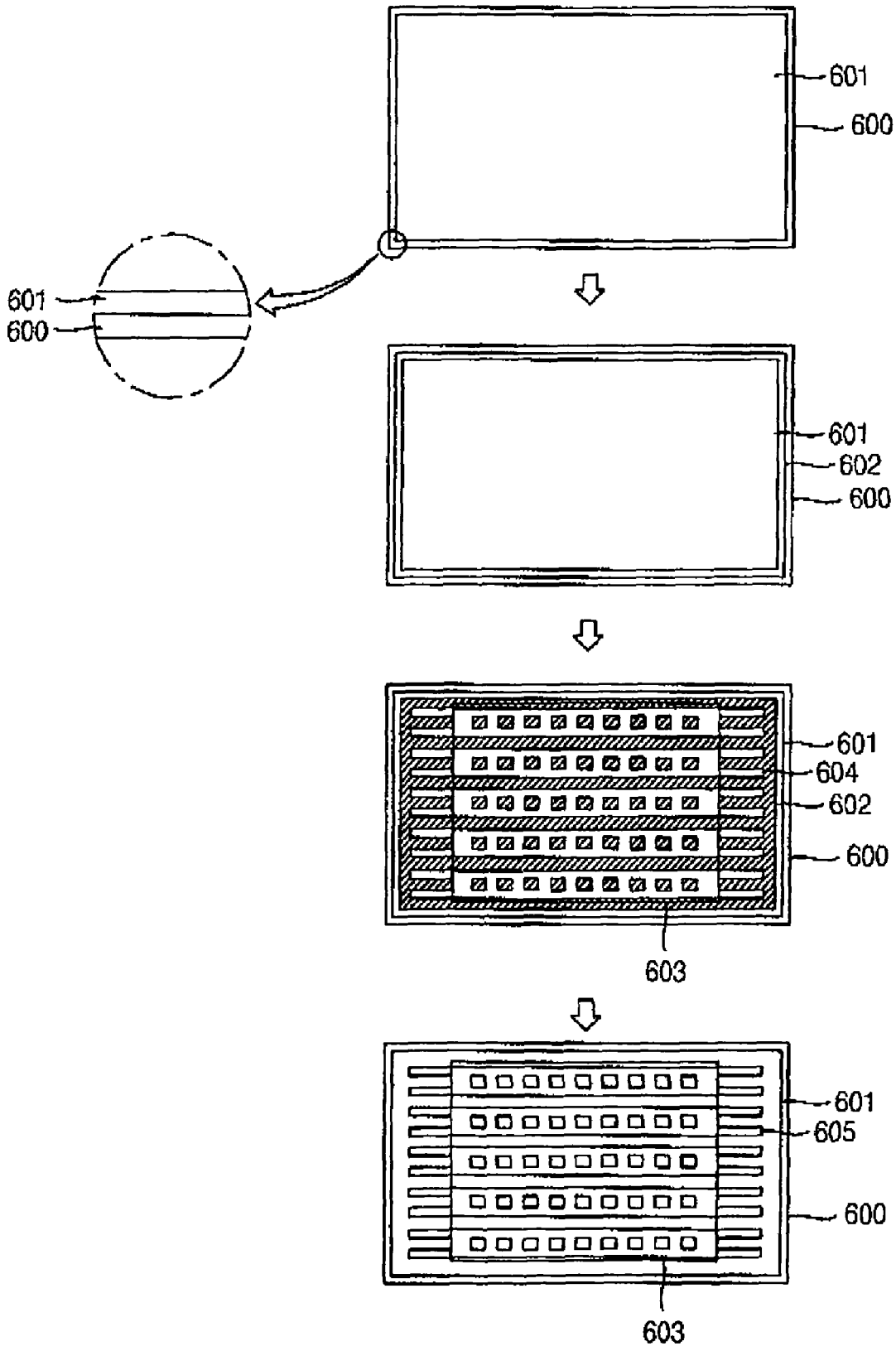
FIG. 6 is a diagram sequentially illustrating a manufacturing process of a rear panel of the plasma display panel according to the present invention.

FIG. 6 is a diagram sequentially illustrating a manufacturing process of a rear panel of the plasma display panel according to the present invention.

As described in FIG. 6, in the rear panel of the plasma display panel according to the present invention, a dielectric layer 601 is formed on a rear glass 600. The dielectric layer (not shown) is formed with a screen printing method of printing by coating a dielectric paste or a lamination method of laminating a film manufactured in a lamination sheet using a roller, etc.

A paste (not shown) for a barrier rib having a predetermined thickness is formed on the dielectric layer 601. At this time, the paste for the barrier rib is formed with a printing method of using a black material or a coating method to reduce a reflection ratio by external light.

Thereafter, a dry film photo resist (hereinafter, referred to as "DFR") 602 is formed through a lamination process on the paste for the barrier rib and a photo mask 604 is aligned on the DFR to illuminate light such as ultraviolet rays. At this time, the photo mask has a predetermined pattern which is extended and protruded by a predetermined length from an effective surface 603 of the panel.

In the DFR in which light is illuminated, an unhardened portion is cleaned through a developing process and a hardened paste is formed with a barrier rib 605 through a sandblasting method or an etching method.

Thereafter, a plastic working process is performed and a barrier rib structure after the plastic working process is shown in FIG. 7.

Figure 7A:
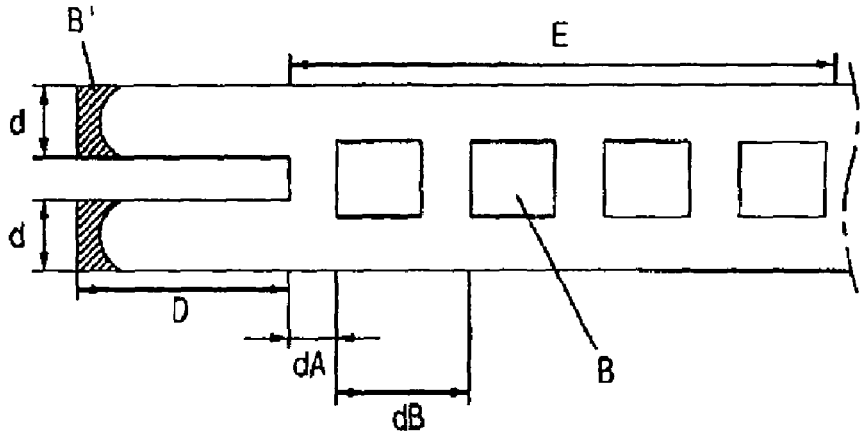
FIG. 7A is a diagram illustrating an example of a barrier rib structure of the plasma display panel according to the present invention.

FIG. 7A is a diagram illustrating an example of a barrier rib structure of the plasma display panel according to the present invention.

Referring to FIG. 7A, the barrier rib structure of the plasma display panel according to the present invention is composed of a main barrier rib (E) which forms a unit discharge cell on the effective surface of the panel and an auxiliary barrier rib (D) which extends and protrudes from the main barrier rib by a predetermined length from the effective surface of the panel.

At this time, a length of the auxiliary barrier rib (D) is formed to be longer than a length (dB) of a unit discharge cell.

In addition, the auxiliary barrier rib (D) is formed on an ineffective surface of the plasma display panel not to have an influence on an image display characteristic of the plasma display panel. Here, the ineffective surface is an area in which an image is not displayed in the plasma display panel. For instance, the ineffective surface does not comprise a discharge cell.

As shown above, the auxiliary barrier rib (D) serves as a buffer which protects an influence of contraction (B') so that it does not transmitted to the main barrier rib (E), preventing deformation of the main barrier rib (E).

The auxiliary barrier rib according to the present invention shown in FIG. 7A is protruded in a horizontal direction from an effective surface of the panel, but it may be protruded in a vertical direction from the effective surface of the panel. That is, the auxiliary barrier rib (D) is protruded in at least one direction among a horizontal direction or a vertical direction from the effective surface of the panel. For instance, the auxiliary barrier rib (D) can protrude from a vertical or horizontal rib portion of the main barrier rib (E).

Because the tip of the auxiliary barrier rib may be more seriously deformed than other regions, the end portion of the auxiliary barrier rib may be made to be thicker than the other portion of the auxiliary barrier rib.

In addition, the present invention may be implemented to have different width and length of the auxiliary barrier. This will be described in detail.

Figure 7B:
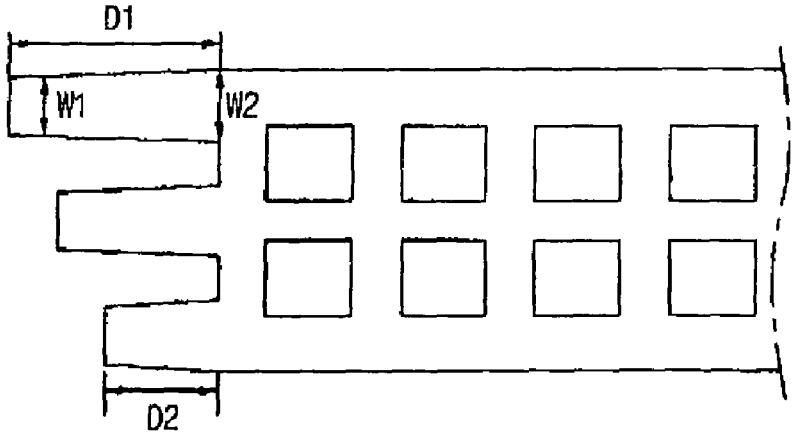
FIG. 7B is a diagram illustrating another example of the barrier rib structure of the plasma display panel according to the present invention.

FIG. 7B is a diagram illustrating another example of a barrier rib structure of the plasma display panel according to the present invention and illustrating the auxiliary barrier rib in an upper side of the panel.

As described above, the present invention is provided with the auxiliary barrier rib having a plurality of protrusions. The barrier rib structure of the plasma display panel according to the present invention can be implemented to have various widths and lengths of the protrusion.

As shown in FIG. 7B, another example of the barrier rib structure of the plasma display panel according to the present invention may be embodied so that a length (D1) of the protrusion in an upper part of a panel is longer than that of the protrusion in a central part of the panel. In addition, a width (W1) of the tip of the protrusion can be embodied to be smaller than a width (W2) of the other portion.

Figure 7C:
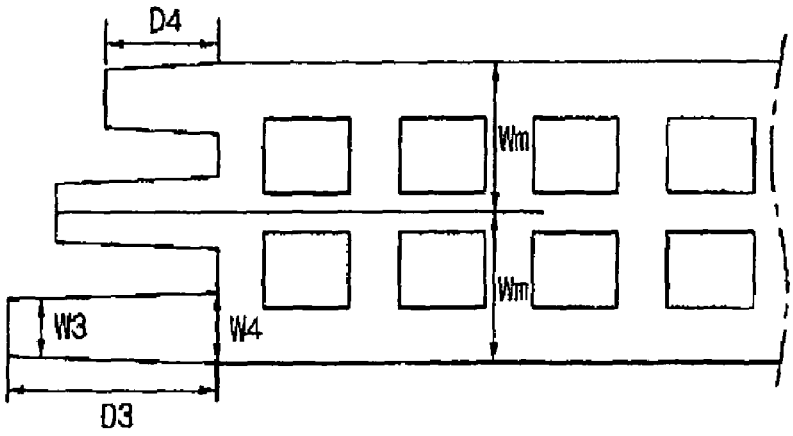
FIG. 7C is a diagram illustrating a further example of the barrier rib structure of the plasma display panel according to the present invention.

FIG. 7C is a diagram illustrating another example of the barrier rib structure of the plasma display panel according to the present invention, showing the auxiliary barrier rib in a lower side of the panel.

As shown in FIG. 7C, another example of the barrier rib structure of the plasma display panel according to the present invention can be embodied so that a length (D3) of the protrusion in the low part of the panel is longer than a length (D4) of the protrusion in the central part of the panel. In addition, as described above, a width (W3) of the tip of the protrusion can be embodied to be smaller than a width (W4) of the other portion.

In this case, the present invention may be embodied so that a width of the protrusion is smaller than that of the main barrier rib. For example, in FIG. 7C, a width (W4) of the protrusion is embodied to be smaller than a width (Wm) of the main barrier rib.

In the meantime, as shown in FIG. 7A, FIG. 7B and FIG. 7C, the tips of the auxiliary barrier rib are not connected each other. When the tips of the protrusions are closed, the protrusions are not considered as an auxiliary barrier rib. Hence, it is possible to tell an auxiliary barrier from dummy cell.

As described above, the auxiliary barrier rib can be embodied in various forms and is made to prevent deformation of a discharge cell depending on various deformations which can generate during a plastic working process.

The plasma display panel comprising the barrier rib can sustain a specific shape of a discharge cell because it is not deformed at a high temperature during a plastic working process. Therefore, a discharge characteristic is not influenced by driving the plasma display panel. Hence, it is possible to improve reliability of the plasma display panel.

As described above, it will be obvious that the same may be varied in many ways. Such variations are not to be regarded as a departure from the spirit and scope of the invention, and all such modifications as would be obvious to one skilled in the art are intended to be comprised within he scope of the following claims.

What is claimed is:

1. A plasma display panel comprising:

a main barrier rib forming a cell; and an auxiliary barrier rib protruding by a predetermined length from the main barrier rib, wherein the auxiliary barrier rib comprises at least two protrusions and ends of the protrusions are not connected with each other, wherein the at least two protrusions of the auxiliary barrier rib protrude from a same side of the main barrier rib, wherein the at least two protrusions extend in the same direction, and wherein widths of the ends of the at least two protrusions are smaller than the widths of the other sides of the at least two protrusions.

2. The plasma display panel of claim 1, wherein the main barrier rib is formed on an effective surface of the panel, the effective surface being a display region of the plasma display panel.

3. The plasma display panel of claim 1, wherein the auxiliary barrier rib is formed on an ineffective surface of the panel, the ineffective surface being a non-display region of the plasma display panel.

4. The plasma display panel of claim 1, wherein the predetermined length is longer than a length of a unit cell.

5. The plasma display panel of claim 1, wherein the auxiliary barrier rib extends in at least one of a horizontal direction or a vertical direction from the effective surface of the panel.

6. The plasma display panel of claim 1, wherein lengths of the at least two protrusions are different from each other.

7. The plasma display panel of claim 6, wherein a length of the protrusions in an upper part or a lower part of the panel is longer than a length of the protrusions in the center.

8. The plasma display panel of claim 1, wherein a thickness of the protrusions in an upper part or a lower part of the panel is greater than a thickness of the protrusions in the center.

9. The plasma display panel of claim 1, wherein a width of the auxiliary barrier rib is smaller than the width of the main barrier rib.

10. The plasma display panel of claim 1, wherein the auxiliary barrier rib protrudes from a location in the main barrier rib where a vertical portion and a horizontal portion of the main barrier rib intersect.

11. The plasma display panel of claim 1, wherein the auxiliary barrier rib protrudes horizontally from a location of a vertical portion of the main barrier rib where the vertical portion of the main barrier rib does not intersect with a horizontal portion of the main barrier rib at the location.

12. The plasma display panel of claim 1, wherein the auxiliary barrier rib protrudes from another auxiliary barrier rib.

13. The plasma display panel of claim 1, wherein a width of each protrusion at a location where the protrusion protrudes from the main barrier rib is greater than a thickness of a portion of the main barrier rib between two adjacent discharge cells.

14. The plasma display panel of claim 1, wherein the at least two protrusions are located adjacent to each other, and have a uniform width throughout the entire protrusions.

15. A plasma display panel comprising:

a main barrier rib formed on an effective surface of a panel for forming a cell, the effective surface being a display region of the plasma display panel; and an auxiliary barrier rib protruding in at least one of a horizontal direction or a vertical direction from the effective surface of the panel, wherein the auxiliary barrier rib comprises at least two protrusions and ends of the protrusions are not connected to each other, wherein the at least two protrusions of the auxiliary barrier rib protrude from a same side of the main barrier rib, wherein the at least two protrusions extend in the same direction, and wherein widths of the ends of the at least two protrusions are smaller than the widths of the other sides of the at least two protrusions.

16. The plasma display panel of claim 15, wherein lengths of the at least two protrusions are different from each other.

17. The plasma display panel of claim 16, wherein a length of the protrusions in an upper part or a lower part of the panel is longer than a length of the protrusions in the central part of the panel.

18. The plasma display panel of claim 15, wherein a thickness of the protrusions in an upper part or a lower part of the panel is larger than a thickness of the protrusions in the central part of the panel.

19. The plasma display panel of claim 15, wherein a width of each protrusion at a location where the protrusion protrudes from the main barrier rib is greater than a thickness of a portion of the main barrier rib between two adjacent discharge cells.

20. The plasma display panel of claim 15, wherein the at least two protrusions are located adjacent to each other, and have a uniform width throughout the entire protrusions.

21. A plasma display panel comprising:

a main barrier rib formed on an effective surface of a panel for forming a cell, the effective surface being a display region of the plasma display panel; and an auxiliary barrier rib protruding in at least one of a horizontal direction or a vertical direction from the effective surface of the panel, wherein the auxiliary barrier rib comprises at least two protrusions and tips of the protrusions are not connected with each other, wherein the at least two protrusions of the auxiliary barrier rib protrude from a same side of the main barrier rib, and wherein a width of each protrusion at a location where the protrusion protrudes from the main barrier rib is greater than a thickness of a portion of the main barrier rib between two adjacent discharge cells.

22. The plasma display panel of claim 21, wherein the at least two protrusions are located adjacent to each other, and have a uniform width throughout the entire protrusions.

* * * * *

UNITED STATES PATENT AND TRADEMARK OFFICE

CERTIFICATE OF CORRECTION

PATENT NO. : 7,569,990 B2
APPLICATION NO. : 11/283764
DATED : August 4, 2009
INVENTOR(S) : Hongyeol Kim et al.

It is certified that error appears in the above-identified patent and that said Letters Patent is hereby corrected as shown below:

Title Page, Item (54) and at Column 1, lines 1 and 2,

Please change the Title as follows:

PLASMA DISPLAY PANEL HAVING MAIN AND AUXILIARY BARRIER RIBS

Signed and Sealed this

Eighth Day of June, 2010

David J. Kappos

David J. Kappos
*Director of the United States Patent and Trademark Office*